US005729508A

United States Patent [19]

Baker et al.

[11] Patent Number: 5,729,508

[45] Date of Patent: Mar. 17, 1998

[54] ENVIRONMENTALLY SEALED ACOUSTIC TRANSDUCER COUPLING

[75] Inventors: Anthony D. Baker, Eagan; Michael A. Schugt, Minneapolis, both of Minn.

[73] Assignee: Rosemount Aerospace Inc., Burnsville, Minn.

[21] Appl. No.: 653,309

[22] Filed: May 24, 1996

[51] Int. Cl.[6] ..... H04R 1/28

[52] U.S. Cl. ..... 367/176; 367/188; 310/327

[58] Field of Search ..... 310/327, 334; 367/188, 176; 128/662.03

[56] References Cited

U.S. PATENT DOCUMENTS

| | | | |
|---|---|---|---|
| 2,956,789 | 10/1960 | Rich | 310/334 |
| 4,184,094 | 1/1980 | Kopel | 367/152 |
| 4,297,607 | 10/1981 | Lynnworth et al. | 310/334 |
| 4,796,632 | 1/1989 | Boyd et al. | 128/662.03 |
| 5,494,038 | 2/1996 | Wang et al. | 128/662.03 |
| 5,598,845 | 2/1997 | Chandraratna et al. | 128/662.03 |

OTHER PUBLICATIONS

"Ultrasonic Testing of Materials", 4th Revised Editon 1990, by J. Krautkrämer and H. Krautkrämer, Title page, page listing collaborators, Table of Contents (8 pp.), and pp. 187–202.

*Primary Examiner*—Ian J. Lobo

*Attorney, Agent, or Firm*—Westman, Champlin & Kelly, P.A.

[57] ABSTRACT

An environmentally sealed acoustic transducer that utilizes a semi-liquid, liquid or paste-like couplant material between a bottom surface of a transducer case and a structure that is to be acoustically vibrated. The transducer case fits into a chamber or well that provides a seal relative to the outer surfaces of the transducer case, and a weep or bleed passageway is provided and opens to the chamber or well. The bleed passageway permits excess couplant material to move out of the chamber through the passageway when the transducer case is inserted into the chamber or well. The bleed passageway has a seal so that the entire unit is environmentally sealed.

12 Claims, 2 Drawing Sheets

ENVIRONMENTALLY SEALED ACOUSTIC TRANSDUCER COUPLING

This invention was made with Government support under Agreement No. MDA972-94-3-0044 awarded by the Advanced Research Projects Agency. The Government has certain rights to the invention.

BACKGROUND OF THE INVENTION

The present invention relates to acoustically coupling an ultrasonic transducer assembly to a vibrating sensor, such as a plate forming an acoustic channel, utilizing a known couplant material that is liquid, semi-liquid or of a paste consistency, which permits the transducer assembly to be sealed into a receiving housing or well that is bonded to the vibrating sensor. The invention insures that the couplant material fills all voids between the transducer and the channel and yet permits the transducer to seat properly.

Acoustic transducers have been used for transmitting acoustic vibrations to various sensor elements and for sensing changes in vibration caused by external conditions.

In order to obtain satisfactory results from an acoustic transducer it is desired that the vibrating sensor is vibrated reliably with minimum power, and thus it is necessary that there is sufficient acoustic coupling between the transducer and the sensor member that is vibrating.

At present, semi-liquid or paste like couplant materials have been used between the transducer and the sensor, but a problem arises in insuring that the acoustic coupling is of a correct, uniform thickness, and that there are no voids between the transducer and the member to which it is mounted. If excess couplant material is trapped under the transducer it may not seat properly. Further, it is preferable in many applications that the transducer be sealed within a well or chamber in a housing. The couplant material is on the bottom of the transducer and when the transducer is slid into the well along seals, any excess couplant material cannot escape from the well. The spacing of the transducer from the bottom of the well thus cannot be controlled precisely. The layer of couplant material is usually very thin and must be controlled for efficient transmission of acoustic energy is efficiently made.

SUMMARY OF THE INVENTION

The present invention relates to an acoustic transducer inserted into a well or chamber, sealing the exterior surface of the transducer relative to a housing recess or well and at the same time insuring that a liquid or semi-liquid couplant material trapped between the bottom of the well and the seal on the transducer is permitted to be expelled without losing the acoustic coupling. The transducer of the present invention has a "weep" or bleed passage provided through the transducer to the atmosphere, to permit the excess couplant to be forced out of the bottom of the well, while completely filling the space needed for acoustically coupling the transducer to the member on which it is mounted.

After installing the transducer, the bleed passage is sealed with a fastener that has a seal around it. The bleed passage seal prevents the liquid coupling material from evaporating in the atmosphere so that the couplant material remains effective and provides a stable acoustic transmission medium over the life of the transducer.

Generally, the transducer is fixed in the well to maintain a very small gap between its bottom surface and the member on which it is mounted. In one form of the invention, a recess for the couplant material is provided on the bottom of the transducer. The space filled with the couplant material is generally in a range of 0.001 to 0.005 inches, and is called a "liquid coupled bondline".

The use of the "weep" or bleed passage which can be plugged and sealed permits very close tolerances, and ensures that the acoustic coupling will not be destroyed or otherwise compromised by exposure to atmospheric conditions.

DETAILED DESCRIPTION OF THE PREFERRED EMBODIMENTS

Figure 1:
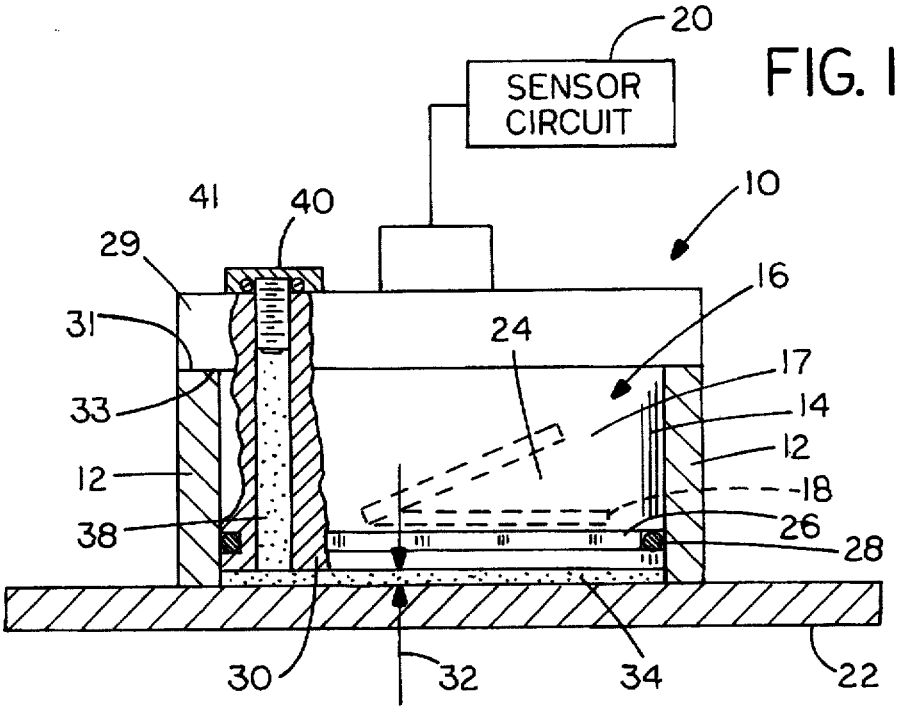
FIG. 1 is a schematic cross sectional view of a typical transducer and well mounted onto an acoustic plate or channel, and showing an acoustic transducer having the coupling arrangement of the present invention installed there.
Figure 2:
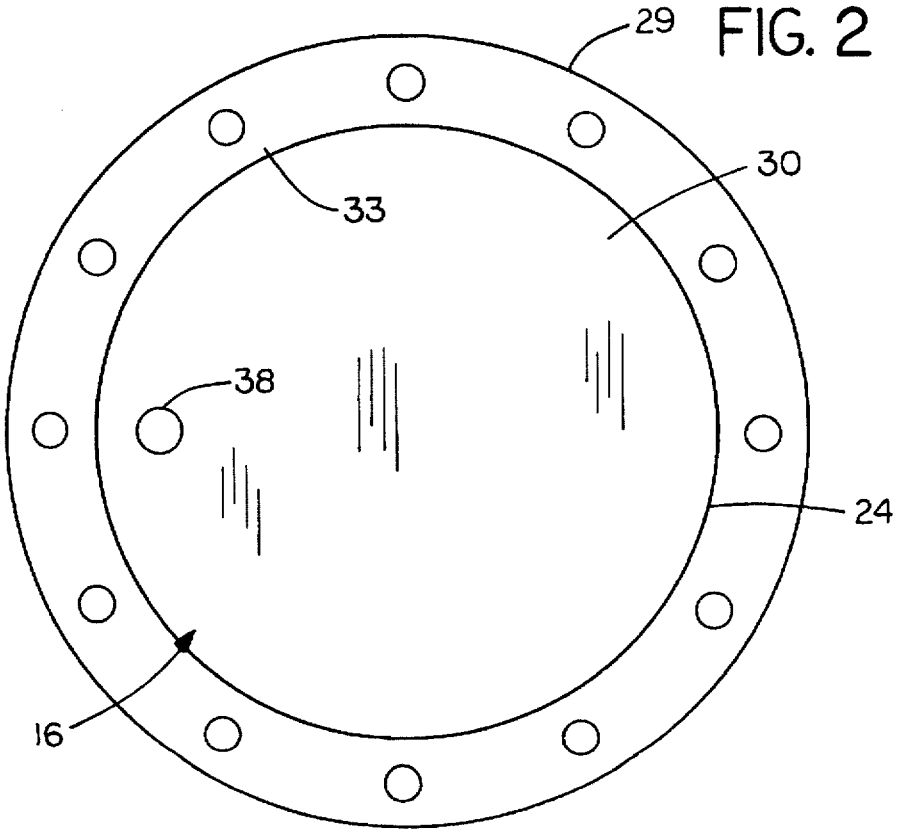
FIG. 2 is a bottom plan view of the transducer of FIG. 1.

In FIG. 1, a transducer and outer housing assembly indicated at 10 includes an outer metal (aluminum) housing 12 that has an interior recess forming a transducer chamber or well 14 that is of size to receive and very closely fit around the outside surface of a transducer case 17 forming part of a transducer assembly 16. The transducer assembly 16 as shown is an acoustic transmission transducer that has a piezoelectric vibration element 18 shown in dotted lines in transducer case 17 that can be driven to vibrate when excited from a suitable circuit 20. The vibrating element 18 sets up vibrations in an acoustic transmission plate 22. The plate 22 can be formed as an acoustic transmission device. The chamber or transducer well 14 is cylindrical, as shown and has an open bottom in the housing so the bottom of the chamber is closed by the acoustic transmission plate 22. A lower portion 24 of the transducer case 17 is also cylindrical, and has an O-ring groove 26 on the exterior in which a suitable elastomeric O-ring 28 is mounted. The elastomeric O-ring 28 makes a tight seal against the interior surface of the chamber or transducer well 14. The transducer case 17 has a suitable mounting flange 29 with an under surface 33 that rests on a top edge surface 31 of the outer housing 12, and is secured thereto with suitable fasteners such as helicoils or rivets. The outer housing 12 itself can be riveted or bonded to the acoustic transmission plate 22, or otherwise securely acoustically coupled to the acoustic transmission plate 22.

A bottom surface 30 of the acoustic transducer case 17 is precisely machined in relation to the bottom edge surface 33 of the mounting flange 29, so that a small, controlled gap indicated by the double arrows at 32 is made between the acoustic transmission plate 22, which forms the bottom surface of chamber 14, as shown, and the bottom surface 30 of the acoustic transducer case 17. This gap is filled with a liquid or semi-liquid (flowable consistency) couplant material indicated at 34, that is commercially available. The couplant material is semi-liquid or paste like preferably even at low temperatures, and will flow slowly under pressure. The material sold under the trademark PYROGEL by Sonotech Inc. of Bellingham, Wash., U.S.A. is satisfactory. This couplant material 34 is used for transmitting acoustic frequency vibrations from the piezoelectric element 18 and the bottom surface 30 of the transducer case to the acoustic transmission plate 22.

It is important that there be no voids in the couplant material 34, and since the bottom of the chamber or transducer well 14 is environmentally sealed by the O-ring 28, the excess couplant material that is applied to the bottom surface 30 before the transducer case 17 is slipped into the chamber 14 does not normally have a way of escaping in a standard arrangement. The excess couplant material thus would result in poor seating of flange 29 onto the upper edge surface 31 of the outer housing 12. Excessive spacing of the bottom of the transducer case 17, or misalignments can then occur.

In order to insure that the semi-liquid couplant material 34 adequately, but not excessively, fills the desired space indicated by double arrows 32, a weep or bleed passageway 38 is provided in the transducer case 17 adjacent to the outer surface thereof, so that any excess couplant material 34 can be expelled to the atmosphere as the transducer case 17 is slipped into the chamber or transducer well 14. The weep or bleed passageway 38 is then sealed with a suitable plug, such as capscrew 40 threaded into the passageway and which can have an O-ring 41 under the capscrew head, if desired, for additional sealing.

In this instance, the couplant material 34 is extruded through the passageway 38 as the flange 29 of transducer case 17 seats on edge surface 30, but only after the bottom gap in which the couplant material 34 is to be provided is completely filled. The passageway 38 is of small diameter so that some pressure is required to extrude the semi-liquid couplant material 34, which ensures that the space shown by double arrows 32 will be filled completely so that effective acoustic coupling will be obtained.

Figure 3:
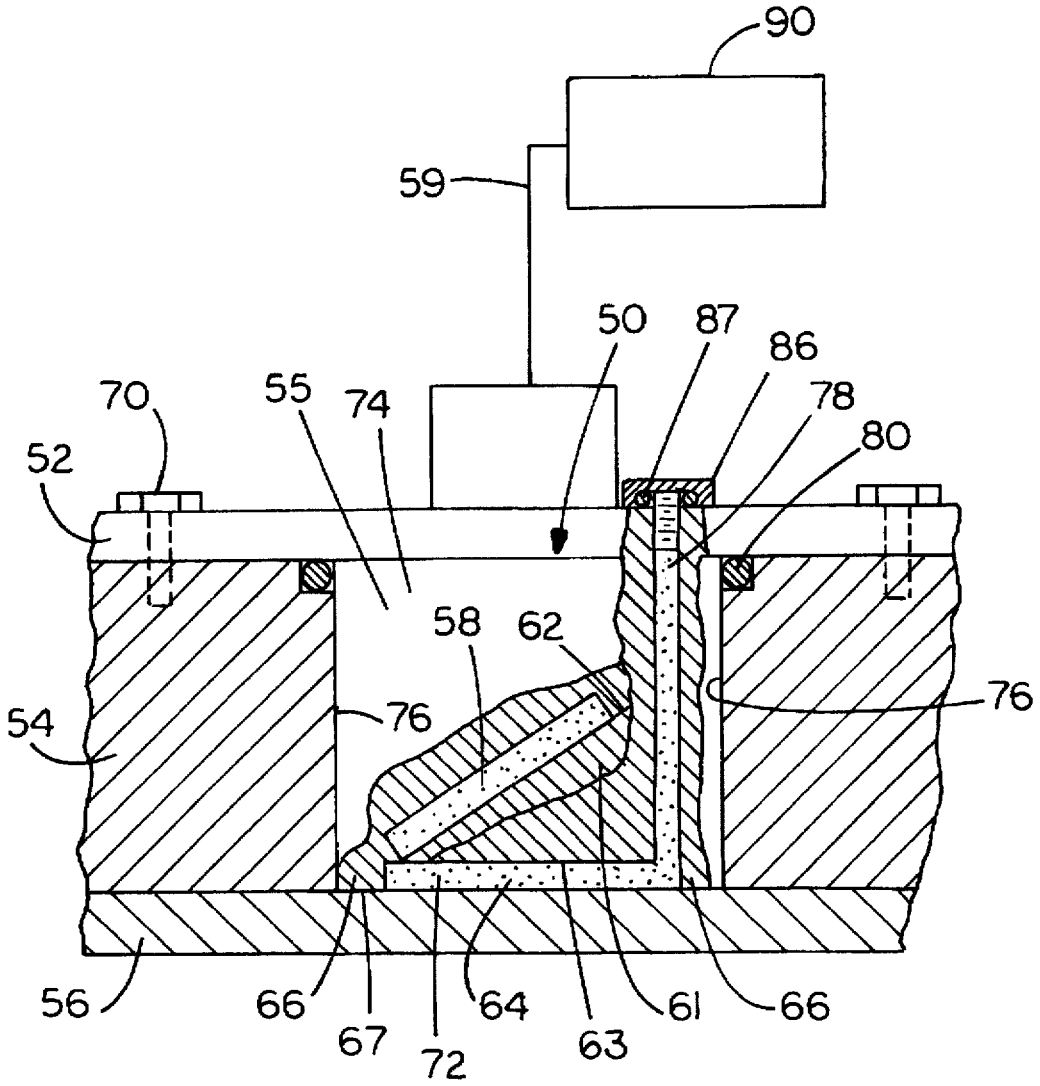
FIG. 3 is a modified form of the invention, illustrating a transducer having a recess for holding the coupling material.

In FIG. 3, a modified form of the invention is illustrated, having an acoustic transducer case 50 with a mounting flange 52 that fits on to the upper edge surface of a housing 54 with the transducer case fitting into a chamber or transducer well 55. The outer housing 54 in turn is secured to and acoustically coupled to an acoustic transmission plate 56.

In this form of the invention, the transducer case 50 has a piezoelectric vibration element 58 mounted therein having a plane inclined relative to a central axis 59 of the transducer case 50. This affects favorably the transmission of high frequency signals along the acoustic transmission plate 56. The plate 56 can be formed as an acoustic channel. A suitable block of mounting material 61 having a wedge like surface 62, can be used for coupling a lower surface 63 of a main portion of the transducer case 50 to the acoustic transmission plate 56. Mounting material block 61 acts as a bottom portion of the transducer case and is provided with a controlled depth bottom recess 64 that is bounded by a thin peripheral rim 66. The lower edge surface 67 of the rim 66 will act as a stop and seat tightly against the acoustic transmission plate 56 when the transducer case 50 is secured to housing 54. The housing 54 is secured to acoustic transmission plate 56. Fasteners, such as those shown at 70, that extend through the outer housing 54 can be utilized for holding both the transducer case 50 and the outer housing 54 onto the acoustic transmission plate 56. The outer housing 54 can be bonded or attached to the plate 56 by other techniques known to those skilled in the art.

The bottom recess 64 of the transducer case is filled with a semi-liquid or paste like couplant material 72, and in this form of the invention, as the cylindrical portion 74 of the transducer case 50 is pushed along the interior surface 76 of the chamber or transducer well 55, the couplant material 72 that has been previously applied generously into the recess 64 will ooze out around the lower edges of the rim 66. A weep or bleed passageway 78 is provided adjacent one side of the transducer case 50 and opens to the recess 66, or as shown, to the lower edge surface of the rim 66. A short passageway from recess 64 to passageway 78 is provided. The outlet passage for couplant materials from recess 61 can be provided along the side wall of the recess, near the inner end of the recess. Any excess couplant material that is squeezed out of recess 64 will be permitted to pass through the passageway 78 the atmosphere. For effective sealing, enough couplant material 72 must initially be applied to recess 64 for the material 72 to be forced through the passageway 78 and to the atmosphere when the transducer case 50 is forced into well 55.

The outer surface of the transducer cylindrical portion 74 and the inner surface 76 of the recess or transducer well can be sealed with a suitable O-ring 80, which in this case is immediately under the flange 52. The O-ring is received in a suitable groove formed in the upper edge of outer housing 54.

After the transducer flange has been tightened into position on the housing, the rim 66 is securely seated in contact with the acoustic transmission plate 56. This seating will insure good acoustic coupling. The couplant material 72 provides acoustic coupling from a bottom surface 63 of the transducer case, which is also the inner surface of recess 64, to the surface of structure 56. The structure 56 closes off chamber or well 55 and forms a bottom surface of the well.

The passageway 78 then can be plugged with a suitable threaded seal plug 86. An O-ring 87 is used underneath the head of plug 86 for sealing. The transducer case 50 (including block 61) squeezes out the excess couplant material 72 in recess 64, by permitting the couplant material 72 to be extruded out through passageway 78 to the atmosphere. The chamber or transducer well 55 is fully sealed from the atmosphere by O-rings in both forms of the invention.

The second form of the invention as shown in FIG. 3 reduces the likelihood that the layer of couplant material at the bottom of the respective transducer case will be affected by the torque of mounting hardware, because the peripheral rim 66 will provide a known depth recess 64 when it is mounted to the acoustic transmission plate 56. The recess 64 should have a depth in the range of 0.001 to 0.005 inches, to provide an adequate coupling for sending acoustic energy generated by the piezoelectric element 58 to the acoustic transmission plate 56. Suitable circuitry 90 is connected to the sensor element 58 with a cable 59 and is utilized for exciting the sensor element 58 into vibration. A similar arrangement can be used for receiving transmitted acoustic frequency signals.

Although the present invention has been described with reference to preferred embodiments, workers skilled in the art will recognize that changes may be made in form and detail without departing from the spirit and scope of the invention.

What is claimed is:

1. An environmentally sealed acoustic transducer having a transducer case with an outer peripheral surface, comprising;

an end surface of the transducer case bounded by the outer peripheral surface, the end surface comprising a region of transmission of acoustic energy from a vibration producing transducer element in the transducer case to a structure;

an outer housing having a chamber defined by a surface for receiving the transducer case outer peripheral surface, and having a first end and a second end positionable adjacent a structure, a seal around the periphery of the outer surface of the transducer case spaced from the end surface to seal the transducer case relative to the surface defining the chamber and enclose a space between the end surface and the second end of the chamber; and a passageway opening into the chamber between the seal and the second end of the chamber, and extending to a location that is to the exterior of the outer housing when the transducer case is positioned in the chamber to permit flowable material engaged by the end surface of the transducer case to escape through such passageway as the transducer casing is moved into the chamber from the first end toward the second end.

2. The acoustic transducer of claim 1, wherein a seal member is provided for sealing the passageway at an exterior portion of the passageway.

3. The acoustic transducer of claim 1, wherein said seal comprises an O-ring surrounding the periphery of the outer surface of the transducer case and fitting within the chamber.

4. The acoustic transducer of claim 1, wherein the chamber is a through chamber and a bottom surface of the chamber is formed by a structure on which the outer housing is mounted, and wherein the transducer case includes a stop surface for supporting the end surface of the transducer case closely adjacent to but spaced from the structure forming the bottom surface of the chamber to permit a flowable vibration couplant material to engage both the end surface of the transducer case and the structure.

5. The acoustic transducer of claim 4, wherein said stop surface defines a peripheral rim surrounding the majority of the end surface of the transducer case, the rim spacing the majority of the end surface from the structure a desired amount, and the couplant material being retained within said peripheral rim.

6. The acoustic transducer of claim 4 including a mounting flange for the transducer case, the mounting flange being positioned at a known distance from the end surface of the transducer case, and said outer housing being adapted to support the mounting flange with the end surface spaced a desired amount from the structure to be vibrated.

7. The acoustic transducer of claim 4, wherein the spacing between the end surface of the transducer case and the structure is in the range of 0.001 to 0.005 inches.

8. An environmentally sealed acoustic transducer having a transducer case with a vibrating end surface for transmission of acoustic vibrations to a structure, comprising;

an outer housing having a chamber open at both first and second ends for mounting the transducer case therein, the second end being open to the structure to be vibrated;

a layer of a flowable vibration couplant material in the chamber between the end surface and the structure;

a passageway opening to a space between the end surface and the structure to permit flowable couplant material engaged by the end surface to flow from between the end surface and the structure when pressure is applied to the flowable couplant material as the end surface is moved toward the structure in the chamber; and a stop operable between the transducer and the structure to position the end surface closely adjacent to but spaced from the structure to provide a known minimum thickness of couplant material between the end surface and the structure.

9. The acoustic transducer of claim 8, wherein the transducer case is sealed around a periphery thereof as the end surface is moved toward the structure.

10. The acoustic transducer of claim 9 wherein a seal member is provided for sealing the passageway at an exterior portion of the passageway.

11. The acoustic transducer of claim 10, wherein the chamber is a through chamber and a chamber end surface is formed by a structure on which the outer housing is mounted, and wherein the stop comprises a stop surface on the transducer case for supporting the end surface of the transducer case.

12. An environmentally sealed acoustic transducer having a transducer case with an outer peripheral surface, comprising;

a bottom surface of the transducer case defined by the outer peripheral surface and defining a region of transmission of acoustic energy from a vibration producing transducer element in the transducer case to a structure;

an outer housing having a chamber defined by a surface for receiving said transducer case outer surface including an O-ring surrounding the periphery of the outer surface of the transducer case and fitting within the chamber to seal the transducer case relative to the surface defining the chamber; and a passageway opening to a space between the O-ring and the structure and leading to an exterior of the outer housing when the transducer case is positioned in the chamber to permit flowable material engaged by the bottom surface of the transducer case to escape through such passageway as the transducer housing is moved into the chamber.

* * * * *